United States Patent [19]

Wagner et al.

[11] 4,183,260

[45] Jan. 15, 1980

[54] TOOL FOR ROTATING NUTS, BOLTS AND LIKE FASTENERS

[75] Inventors: Paul-Heinz Wagner, Much-Birrenbachshohe; Karl-Richard Hirtsiefer, Neunkirchen; Johann Müller, Much-Nesshoven, all of Fed. Rep. of Germany

[73] Assignee: Paul-Heinz Wagner Maschinenfabrikation, Much-Birrenbachshöhe, Fed. Rep. of Germany

[21] Appl. No.: 807,526

[22] Filed: Jun. 17, 1977

[30] Foreign Application Priority Data

| | | | |
|---|---|---|---|
| Jul. 14, 1976 | [DE] | Fed. Rep. of Germany | 2631554 |
| Jul. 14, 1976 | [DE] | Fed. Rep. of Germany | 2631555 |
| Dec. 31, 1976 | [DE] | Fed. Rep. of Germany | 2659798 |

[51] Int. Cl.[2] ..... G05G 1/00

[52] U.S. Cl. ..... 74/575; 74/576; 74/577 M; 74/577 S; 74/577 SF; 74/578; 81/57.39

[58] Field of Search ..... 74/575, 576, 577 R, 74/577 S, 577 SF, 577 M, 578; 81/57.39

[56] References Cited

U.S. PATENT DOCUMENTS

| | | | |
|---|---|---|---|
| 210,251 | 11/1878 | Grosclaude | 75/577 SF |
| 725,682 | 4/1903 | Doeg | 74/577 S |
| 1,030,097 | 6/1912 | Ledeboer | 74/577 M X |
| 1,352,631 | 9/1920 | Ripsch et al. | 74/577 M X |
| 1,402,898 | 1/1922 | Schwerin | 74/575 |
| 1,957,462 | 5/1934 | Kress | 74/578 X |
| 2,655,052 | 10/1953 | Montalto | 74/576 |
| 2,781,666 | 2/1957 | Bosh | 74/576 X |
| 2,831,356 | 4/1958 | Wiman | 74/575 X |
| 2,967,595 | 1/1961 | Zitomer | 74/575 X |
| 3,875,812 | 4/1975 | Chiabrandy | 74/575 X |
| 4,027,561 | 6/1977 | Junkers | 81/57.39 |

FOREIGN PATENT DOCUMENTS

| | | | |
|---|---|---|---|
| 583635 | of 0000 | Fed. Rep. of Germany | |
| 89498 | 3/1896 | Fed. Rep. of Germany | 74/576 |
| 1164184 | 2/1964 | Fed. Rep. of Germany | 74/576 |
| 38378 | 10/1906 | Switzerland | 74/576 |
| 234079 | 4/1969 | U.S.S.R. | 74/575 |
| 482585 | 1/1976 | U.S.S.R. | 74/577 |

*Primary Examiner*—Samuel Scott
*Assistant Examiner*—Daniel J. O'Connor
*Attorney, Agent, or Firm*—Diller, Ramik & Wight

[57] ABSTRACT

This disclosure relates to a tool for rotating elements, such as nuts, bolts, screws or like fasteners, and includes a ring having ratchet teeth, the ring being driven by a lever, a pawl carried by the lever for engaging the ratchet teeth, a flexible tension-applying member in at least partial surrounding relationship to the ring, means for supporting the pawl, and the tension-applying member being disposed between the supporting means and the lever whereby upon movement of the lever in a first direction the pawl rotates the ring through the engagement of a tooth of the ring and the tension-applying member deforms slightly to frictionally grip the ring.

19 Claims, 8 Drawing Figures

TOOL FOR ROTATING NUTS, BOLTS AND LIKE FASTENERS

This invention relates to a tool for rotating a nut, bolt, screw or like element and includes a ring having on an outer periphery thereof ratchet teeth which are engaged by a pawl movably mounted or carried by a lever.

In the case of conventional mechanisms of the type to which this invention is directed (East German Pat. No. 62,789) a head of a wrench is mounted on a ratchet drum which is in turn mounted for rotation in an eye of a lever. There are a plurality of pawls on the lever which engage teeth of the ratchet drum. Rotation of the lever drives the ratchet drum in one direction while free-wheeling of the lever is achieved in an opposite direction. The lever is driven through a reciprocal rod of a piston-cylinder unit to which an end of the lever is articulately connected.

Tools for rotating fastening elements are also known which utilize a friction belt drive (West German Pat. No. 583 635). A sleeve which forms the wrench head has passed around it a tension-applying belt, one end of which is articulately connected to a tension-applying lever while an opposite end is engaged by a projection on the lever such that when the lever is pivoted the two ends of the belt are pressed toward each other so that the head of the wrench is frictionally gripped and at the same time is rotated about its axis. Movement of the lever in an opposite direction releases the friction belt thus neutralizing the driving effect.

In the case of the first patent mentioned (mechanisms in which pawls engage ratchet teeth) there occurs high concentrations of forces at one or a few of the ratchet teeth engaged by the pawl or pawls while the other ratchet teeth are not subjected to any loading whatever. Therefore, the distribution forces are unfavorable and accordingly such mechanisms are necessarily made relatively large and heavy.

In the case of tools utilizing friction belts a relatively even distribution of forces occurs over the periphery of the wrench head but there is a risk of slippage or incomplete driving particularly where it is necessary to transmit high torques. Slippage may also occur when dirt, foreign particles, or the like are present between the friction belt and the sleeve or wrench head which is driven or rotated thereby.

In keeping with the foregoing, the problems of such known tools have been eliminated by the tool of the present invention by avoiding undesired and intense localized concentration of drive forces between pawls and ratchet teeth while on the other hand there is assured a reliable drive of the wrench head under all circumstances.

In further accordance with this invention a ring which is utilized to drive a fastener has ratchet teeth on its periphery and is at least in part embraced by a curved, flexible tension-applying belt, one end of which is connected to a lever while an opposite end engages a support for a pawl whereby upon motion imparted to the lever in a driving direction there is drive imparted to the ring through the pawl engaging the teeth of the latter and also frictional engagement between the flexible tension-applying belt and the ring.

In keeping with this invention the tool logically links pawl drive and freely-running friction belt systems with the lever having two different functions. On one end the lever forms an end of the flexible tension-applying belt and serves for tightening the latter while on the other it also presses against the support means for the pawl. By virtue of this dual function the pawl is on the one end drawn via the friction-applying belt against the flanks of the ratchet teeth while on the other it is additionally pressed in the same direction by the lever.

The friction-applying belt can pass directly over or upon the backs of the ratchet teeth of the ring although in principle it is also possible to allow the friction-applying belt to engage not only on the ratchet teeth but also on a cylindrical sleeve associated therewith.

Preferably the pawl constructed in accordance with this invention is mounted for sliding movement in a bore of the lever and is biased in a direction toward the ratchet teeth with the pawl preferably having at least two catches which each simultaneously are received in different gaps between the teeth which contributes to the obtainment of a greater distribution of forces than would occur through the use of a single catch.

Due to manufacturing tolerances the ratchet teeth of the ring and of the two catches which project from a common block cannot be made sufficiently narrow such that both catches are subject to exactly the same loading and therefore the catch which is the first to engage in the locking condition is biasingly mounted so that it does not receive the total loading in the drive direction but is capable of retracting under drive and transmits a part of the load to the adjacent catch. With regard to tooth pitch, the elastic catch is not exactly in phase to match the remaining catch of the pawl but leads slightly to ensure that this catch is the first to be loaded. This means that when the ring is rotated in the free running direction the elastic catch runs over the vertex of a tooth of the ratchet a trifle later than the other catch. It may happen that reversal of the direction of rotation of the ratchet mechanism occurs just at the moment when a catch has already engaged but is still on the flank of a ratchet tooth and has not yet completely dropped or clicked into place. Therefore, the pawl cannot fully engage which in the case of a heavy drive load or force, for example a hydraulically operated load, can lead to damage or destruction of the pawl.

It is thus an object of this invention to provide a tool of the type aforesaid having as part of one of the catches a return stop or projection which ensures that either the catches fully engage the ratchet ring teeth or the ring turns back by one tooth so that even in borderline cases there is a guarantee that the catches always fully engage the ratchet. The return stop is a spring biased projection carried by one of the catches which is disposed in front in the free-running direction of the ratchet ring. If during retrorotation of the ring the front edge of the projection is passed by the tip of a ratchet tooth the pawl carrying the teeth snaps fully into the teeth causing the projection to spring back. If the tip of the extended projection is not reached, the catch slides off the tooth and moves back into its previous position. In this twin catch arrangement the projection also fulfills the task of compensating for the phase lead of the other catch which is spring biased and of ensuring that the rigid catch does not engage in the ring once the elastic catch has reached a position in which it is also possible for it to engage the ratchet teeth. Therefore, the projection is preferably carried by a rigid catch and the spring biasing the same need not be capable of withstanding relatively heavy loads. The loading of the projection is through a spring that is therefore naturally very much softer than the force of a spring which acts on the rigid catch of the overall pawl.

Furthermore, while the projection is logically employed in the case of dual catches of a pawl this same measure can be applied to a single catch of a single pawl to ensure that the tip of the catch or projection cannot become hooked together with the tip of a ratchet tooth.

A novel tool for rotating a screw, bolt, nut, or similar fastening element is clearly shown in FIGS. 1–6 of the drawings and includes a generally L-shaped housing 1 (FIG. 1) within which is a ring 10 having teeth (unnumbered) on an exterior peripheral surface thereof which are engaged by a pawl 14.

Figure 3:
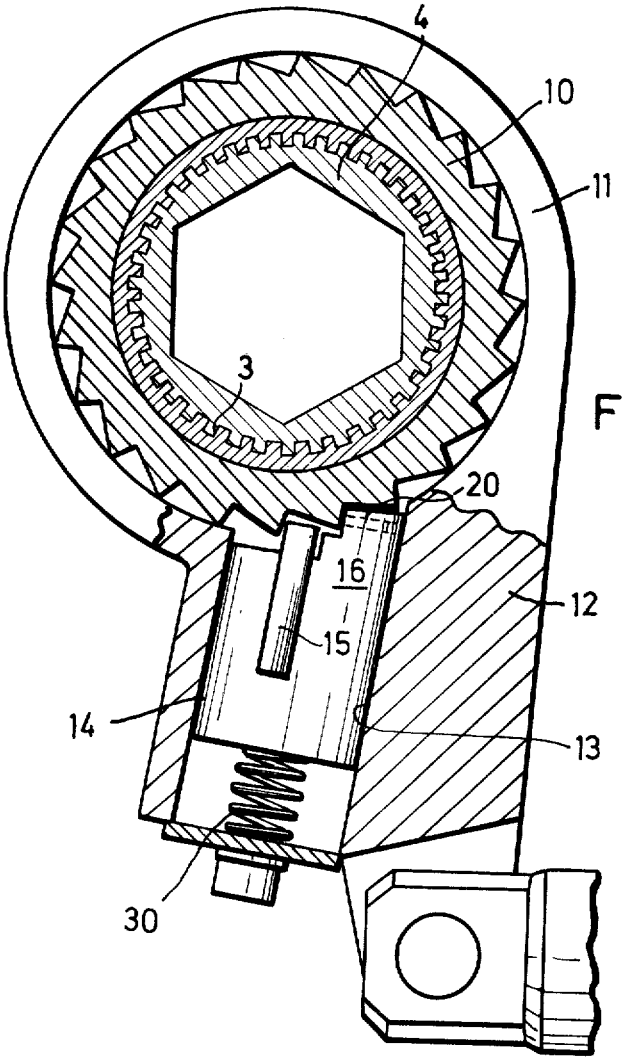
FIG. 3 is a highly enlarged fragmentary side elevational view of the lever or drive head of the tool, and illustrates details of the pawl and dual catches thereof.

Rigidly mounted in a long cylindrical arm portion (unnumbered) of the housing 1 is a hydraulic piston-cylinder unit 40. An extensible piston rod 45 is mounted for reciprocal movement in the unit 40 and an end (unnumbered) thereof is connected to an arm or lever 12 (FIG. 3). The housing 1 has apertures (unnumbered) through which a wrench socket 4 can be inserted into the ring 10 in the manner clearly apparent from FIGS. 1 and 2. The ring 10 includes encircling grooves (unnumbered) into which are inserted spring retaining rings 2 by which the ring 10 is locked in the housing 1 so that it cannot fall therefrom or be accidentally removed. The ring 10 has internal teeth 3 into which fits corresponding gaps on the exterior peripheral surface (unnumbered) of the wrench socket 4. Thus wrench socket 4 is pushed into the opening of the ring 10 and becomes rotationally rigidly connected thereto. Thus, when the ring 10 is turned, the socket 4 is entrained to turn therewith for imparting movement to a fastener, such as a nut, received within the hexagonal opening (unnumbered) of the wrench socket 4.

Figure 2:
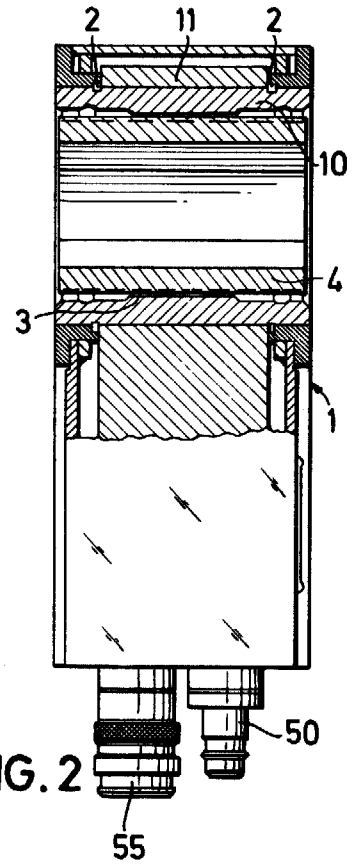
FIG. 2 is a fragmentary end view of the tool of FIG. 1, and illustrates details of the ratchet ring including a wrench socket disposed therein.
Figure 1:
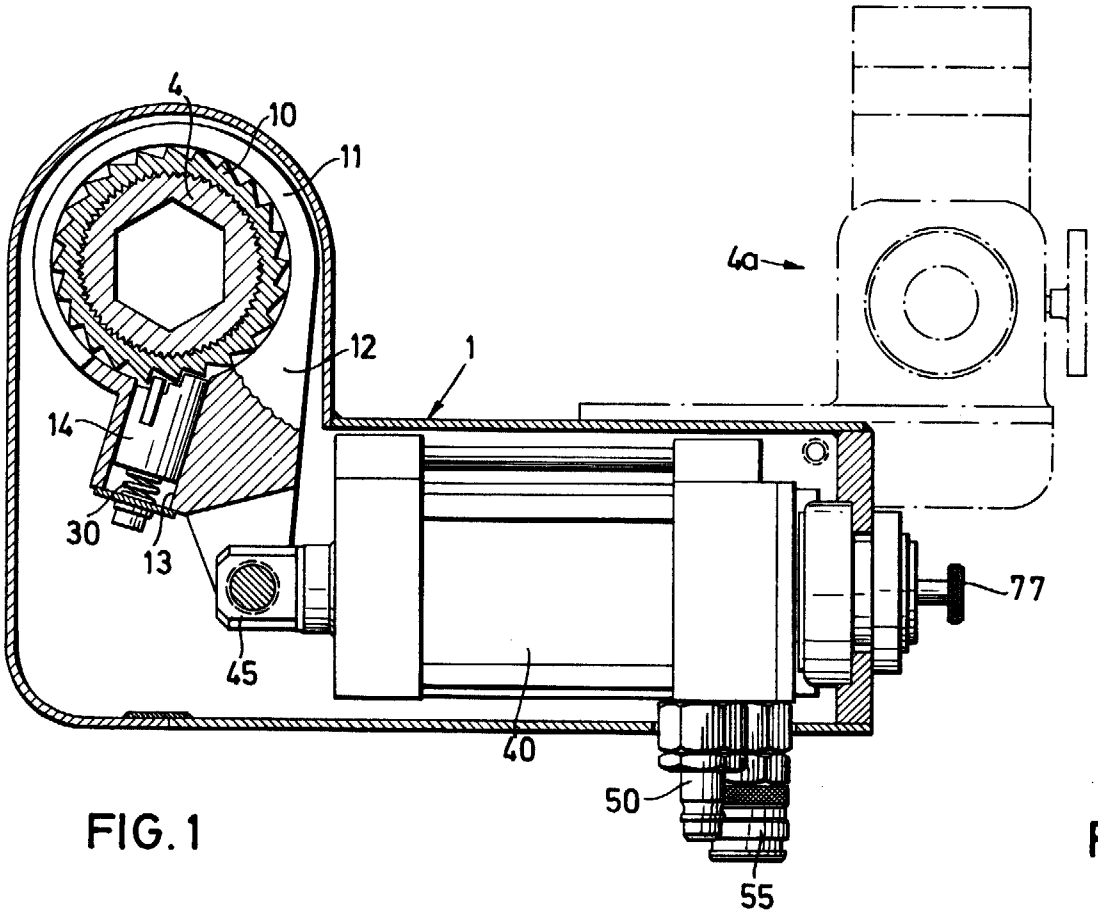
FIG. 1 is a longitudinal sectional view through a tool of this invention, and illustrates a lever carrying a pawl and having a friction-applying belt encircling a toothed ratchet ring.

As is illustrated in FIG. 1, it is possible to provide on the housing 1 a support 4*a* to dissipate the reaction forces which occur when bolts, nuts, or similar elements are tightened by the tool. However, in principle, the tool is capable of functioning without the support 4*a* by simply bracing the housing 1 against a suitable abutment.

Referring specifically to FIG. 3, there is passed around the ratchet teeth (unnumbered) of the ratchet ring 10 a flexible friction belt or friction-applying belt 11 having opposite ends (unnumbered) which merge with the lever 12 at opposite sides of the pawl 14 (FIG. 3). One end of the friction belt 11 merges tangentially relative to the ring 10 with the tension-applying lever 12 while the left-hand end (FIG. 3) is connected to the tension applying lever almost at a right-angle.

The pawl 14 is displaceably or shiftably disposed in a bore 13 of the tension-applying lever 12. The extension of the axis of displacement of the pawl 14 extends in the manner of a secant through the ring 10 and is virtually at right angles to oblique flanks (unnumbered) of the teeth (unnumbered) of the ratchet ring 10. A spring 30 seated upon a plate (unnumbered) at a rear end of the bore 13 normally biases the pawl 14 in a direction toward the ratchet ring 10. The pawl 14 has two catches 15, 16 which engage synchronously into respective adjacent pairs of gaps (unnumbered) between the ratchet or saw teeth (unnumbered) of the ratchet ring 10.

In the case of the present embodiment of the invention the orientation of the ratchet teeth is such that a rotation of the ring 10 in a clockwise direction constitutes the free-running direction while rotation of the ring 10 in a counterclockwise direction is blocked by the pawls 15, 16. This blocking action can be overcome if the pawl 14 is pulled back against the biasing force of the spring 30 by an appropriate adjusting mechanism.

Figure 4:
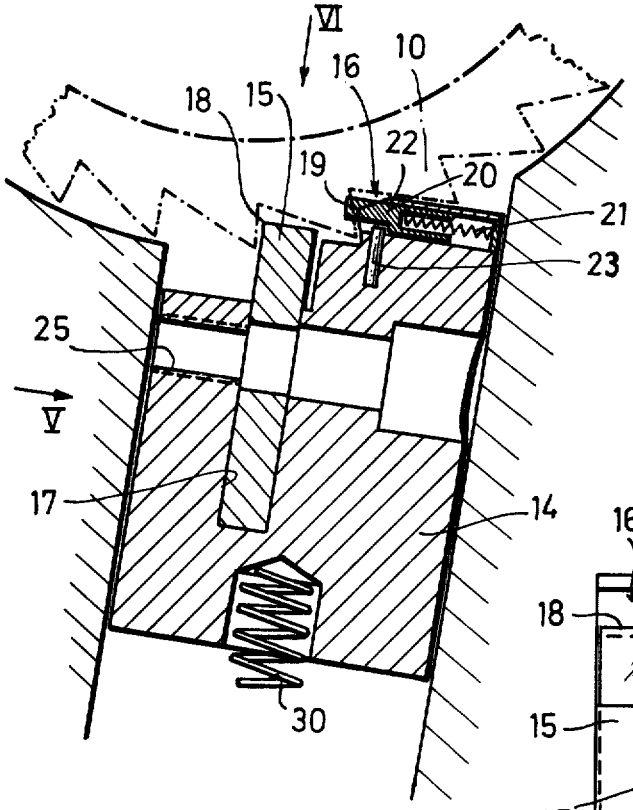
FIG. 4 is a view similar to FIG. 3, and more specifically illustrates details of the pawl including a spring bias projection carried by one of the catches.
Figure 5:
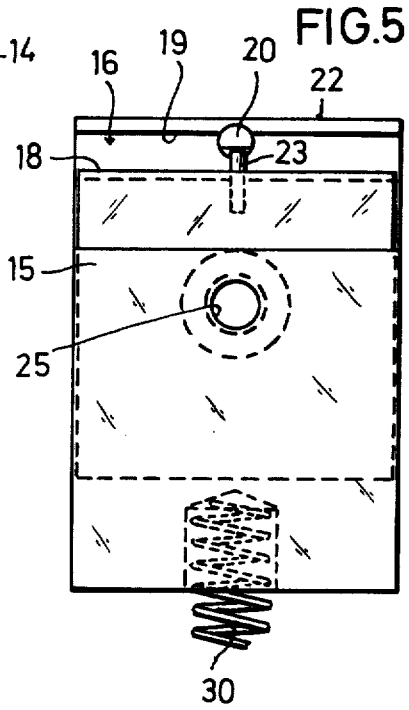
FIG. 5 is a view taken from the direction indicated by the arrow V of FIG. 4, and illustrates additional details of the pawl.
Figure 6:
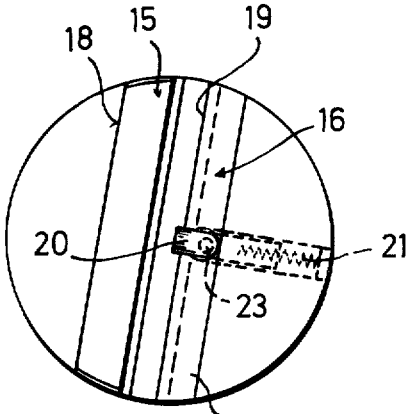
FIG. 6 is a top full plan view as viewed from the direction of the arrow VI of FIG. 4, and illustrates further details of the pawl.

The construction of the pawl 14 is set forth in detail in FIGS. 4 through 6 to which attention is directed. The catch 15 which is in front in the free-running direction consists of a plate of springy material which is inserted into a corresponding slot 17 in the pawl 14 and which protrudes outwardly therefrom to engage a steep flank (unnumbered) of a tooth (unnumbered) of the ratchet ring 10. The steep flank of an adjacent tooth of the ring 10 is engaged by a rigid catch 16 which is integrally formed as part of the pawl 14.

The leading catch 15 preferably has a slight springing effect so that the blocking load of the ring 10 is as far as possible evenly distributed over the two catches 15 and 16. The catch 15 must therefore have a certain phase lead over the catch 16, i.e., it must be slightly in advance of that position which it would ideally assume. If, therefore, the tips of the teeth of the ring 10 run past the catches 15, 16 in the free-running direction, one tooth tip first passes over an edge 19 of the catch 16 and quite briefly afterwards the tip of the preceding tooth passes over an edge 18 of the catch 15. To prevent any blocking action with this brief period in which only the catch 16 but not the catch 15 is engaged the catch 16 is provided with a spring-loaded stud or projection 20 which projects from within a bore (unnumbered) of the catch 16 under the influence of a spring 21. In the extended or projected position of the projection 20 the latter is an extension of a sliding flank 22 of the catch 16 on which the oblique flanks of the ratchet teeth run as the ring 10 rotates in the free-running or free-wheeling direction. Therefore, when rotated in the free-running direction, the projection 20 extends in effect the flank 22 so that the tip of the next leading tooth of the ratchet ring 10 has reliably overstepped the front edge 18 of the catch 15 when the rear catch 16 engages. When it clicks into place the projection 20 is pushed back from the steep flank of the relevant tooth against the action of the spring 21.

The projection 20 is a relatively small stud which is inserted into an appropriate bore in the catch 16, as can be seen particularly in FIGS. 5 and 6. In order to restrict the movement of the projection 20 and at the same time to act as a lateral abutment against total projection outwardly of the bore a metal pin 23 is located in a bore (unnumbered) of the catch 16 and engages a shoulder (unnumbered) of the projection 22 (FIG. 4).

In order to attach the catch 15 to the pawl 14 the latter has a bore 25 which is threaded and into which can be threaded a bolt having first been passed through bores (unnumbered) associated with the catch 15 and the pawl 14 to the right of the catch 15, as viewed in FIG. 4.

As the piston rod 45 is extended the tension-applying lever 12 is at each stroke pressed leftwardly and via the dual pawl 14 the ring 10 rotates clockwise. At each return stroke the tension-applying lever 12 is pivoted back rightwardly and the catches 15, 16 slide on the rear flanks of the ratchet teeth of the ratchet ring 10 so that the spring 30 is compressed and the ring 10 is no longer entrained.

The design and mode of operation of the piston-cylinder unit 40 will now be described.

Within a cylinder 39 of the piston-cylinder unit 40 is disposed a working piston 41 which separates the cylinder 39 into two fluid chambers 42, 43 and for this purpose the piston 41 carries an annular seal or packing 44. A piston rod 45 of reduced diameter extends from the piston 41 outwardly through an end face 46 of the cylinder 39 and an aperture (unnumbered) through which the rod passes is sealed by a packing 47.

A control slide valve 48 is mounted displaceably in a bore (unnumbered) in a front end wall 49 of the unit 40. In one of its positions (FIG. 7) the valve 48 fluidically links a pressure line 50 via an annular space 51 with the chamber 43 so that the hydraulic pressure acts on the entire front surface of the piston 41. At the same time annular spaces 53, 54 are connected to each other so that a line 52 which connects the interior of the chamber 42 to the annular space 53 is connected to a return line 55 which is connected to the annular space 54. In the other position of the control slide valve 48 the annular spaces 51 and 53 are connected to each other while the chamber 43 is connected to the annular space 54 via a longitudinal bore 56 in the interior of the control slide valve 48.

The piston 41 has on an end wall defining the cylinder chamber 43 a cut-out 57 into which in the retracted position of the piston 41 a projection 58 protruding from the inside of the end wall engages. Between the projection 58 and the wall of the cut-out 57 there is sufficient space not to impede the passage of pressurized hydraulic fluid, such as oil. The projection 58 is likewise drilled through in the longitudinal direction so that the control slide valve 48 can slide within it. The projection 58 has on the inside two annular slots 59, 60 which serve as engagement points for a ball catch or latch. The ball catch consists of two balls 62, 62, a part of the surface of each of which protrudes from a transverse bore (unnumbered) in the control slide valve 48 with the balls 62, 62 being biased apart by a spring 61. The balls engage in either of the annular slots 59 or 60 and so stabilize or maintain the two possible positions of the control slide valve 48. The bore 56 of the control slide valve 48 communicates with the chamber 43 constantly through the bore (unnumbered) of the ball catch and through oblique bores (not shown), and there is between the outer wall of the projection 58 and the inner wall of the cut-out 57 such an intermediate space that the distribution of pressure is even over the entire front face of the piston 41.

The piston rod 45 has a longitudinal bore 62' into which projects a rod 63 which is rigidly connected to the control slide valve 48. The rod 63 serves as a guide for a sleeve 64 and a disc 65, both of which are freely displaceable on the rod 45. However, there are in the longitudinal bore 62' abutments 66, 67 which limit the longitudinal movement of the sleeve 64 and the disc 65. The abutment 66 consists of an annular shoulder against which bears the disc 65 and the abutment 67 consists of a lock washer disposed in an annular groove (unnumbered) against which the sleeve 64 is supported. Between the sleeve 64 and the disc 65 is a thrust spring 68 which presses the elements 64, 65 away from each other so that each of them is applied against its respective abutment 66, 67.

At an outer end (unnumbered) of the rod 63 is stop means in the form of a nut 69 against which the disc 66 may abut. An opposite stop or stop means is formed by an end wall or annular shoulder 70 of the control slide valve 48. Against the annular shoulder 70 abuts a projection 71 of the sleeve 64 when the working piston moves to the right as viewed in FIGS. 7 and 8.

Figure 7:
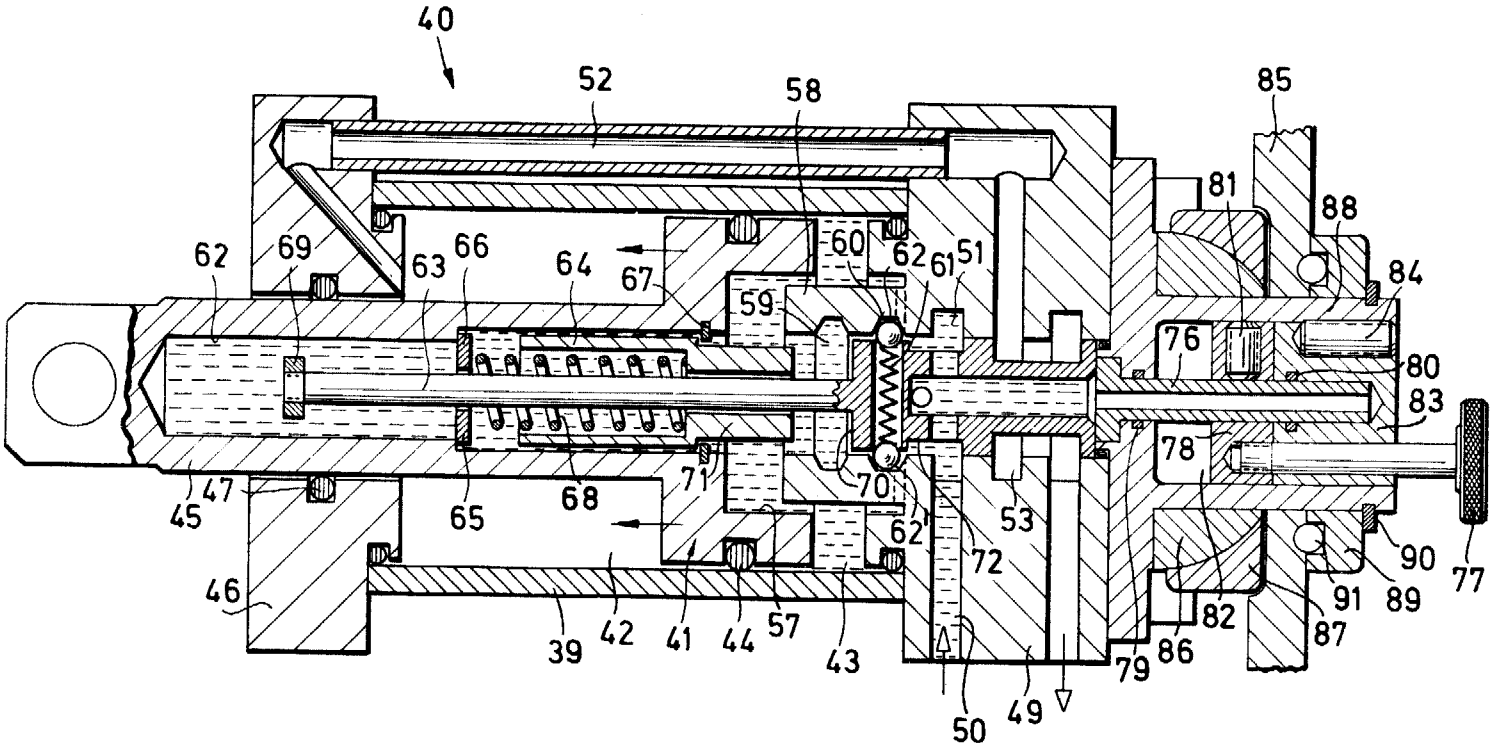
FIG. 7 is a longitudinal sectional view through a piston-cylinder unit of the invention associated with the lever 12, and illustrates components thereof during the working stroke of an associated piston whose rod is connected to the lever.

Reference is now made to FIG. 7 which illustrates the phase of the stroke of the unit 40 in which the pressure line or duct 50 is placed in fluid communication with the chamber 43 through the annular space 51 and the oblique ducts or ports (unnumbered) earlier mentioned adjacent to a narrowed or reduced portion 72 of the control slide valve 48. The pressure thus introduced into the chamber 43 from the pressure line 50 is directed against the entire right-handmost face (unnumbered) of the piston 41 an additionally enters the bore 56 of the control slide valve 48. Due to the position of the control slide valve 48 the chamber 42 is connected through the line 52 to the return line 55 via the annular spaces 53 and 54.

The piston 11 under the influence of the hydraulic fluid in the chamber 43 moves to the left, the elements 64, 65 being entrained therewith, and the spring 68 remaining in its biased condition. As soon as the element 65 strikes the annular abutment shoulder 66 the spring 68 is compressed and after the elements 64, 65 strike against each other in the final phase of this stroke, the balls 62, 62 are forced out of the annular groove 60 because the control slide valve 48 is now entrained by the piston 41 through the abutment means 67 and the elements 64, 65, 69 and 63. The spring 68 relaxes and drives the control slide valve 48 to the position shown in FIG. 8 in which the balls 62, 62 engage in the annular groove 59. The position illustrated in FIG. 8 corresponds to the return stroke of the piston 41 in which the chamber 42 is connected to the pressure line 50. The piston 41 moves to the right and in the final phase of this movement the projection 71 on the sleeve 64 strikes the abutment means or face 70 of the control slide valve 48 which initially does not move. Instead, the spring 68 is first compressed and only when the disc 65 and the sleeve 64 abut each other do the balls 62, 62 move out of the annular slot 58 so that, during relaxation of the spring 68, control slide valve 48 moves to the right and the balls 62, 62 are urged into the annular slot 60. Afterwards the first-mentioned stroke is repeated under the conditions illustrated in FIG. 7.

Figure 8:
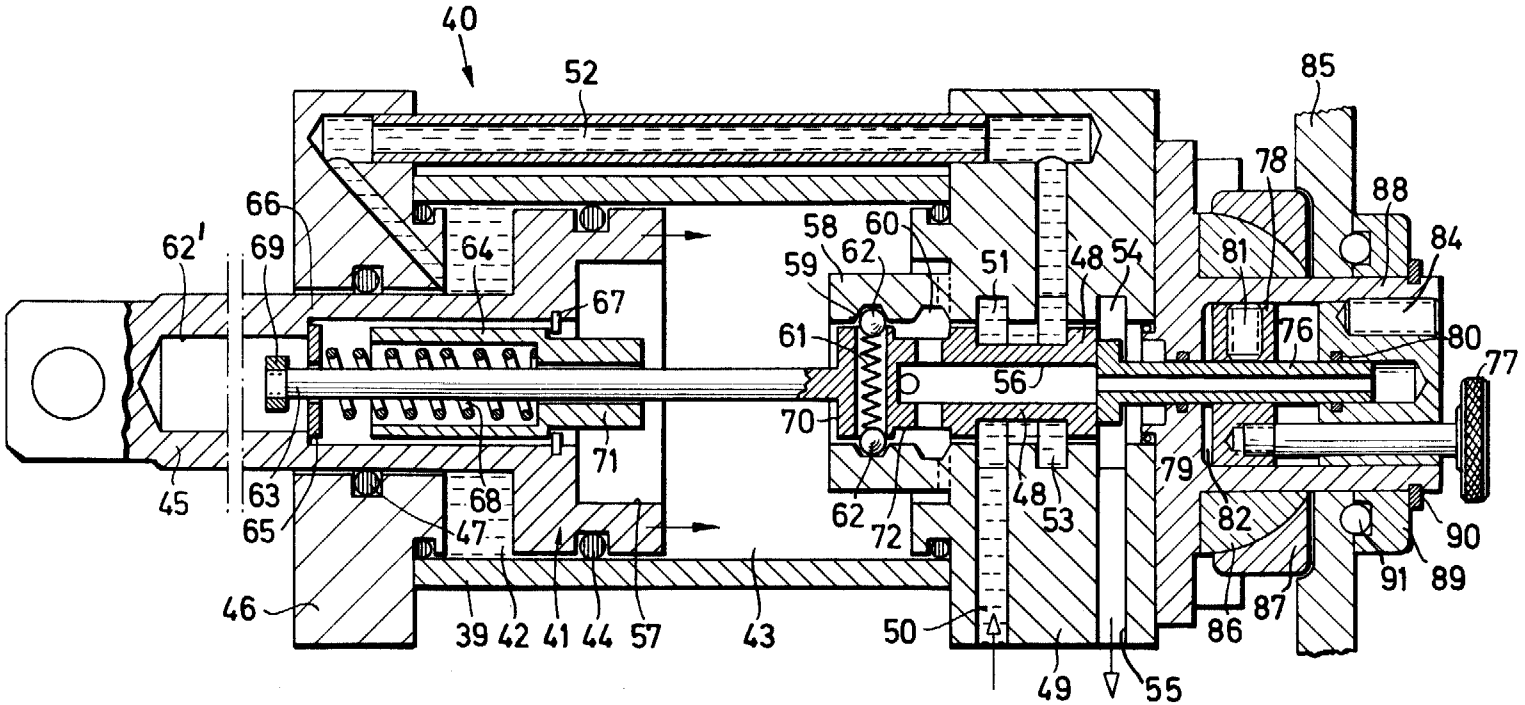
FIG. 8 is a longitudinal sectional view similar to FIG. 7 and illustrates the components of the piston-cylinder unit during the return stroke of the piston.

Apart from the automatic operation of the control slide valve 48 a manual switching device 75 is provided in keeping with this invention by which the control slide valve 48 can be moved manually into the position shown in FIG. 8 so that the piston 41 can be retracted into the cylinder 39 and retained therein. The latter function is desirable in order that the tool can be manually relieved. Should the piston-cylinder unit be immobilized during the phase in which the piston rod 45 is extended then the entire device would be subject to mechanical tension. The switch-over to the rearward position of the control slide valve 48 (FIG. 8) results in an immobilization of the piston-cylinder unit in its relieved or unpressurized condition.

The switching device 75 consists of a tubular sleeve 76 having an interior (unnumbered) which communicates with the longitudinal bore 56 of the control slide valve 48. A ring 78 is clamped rigidly on the tubular sleeve 76 by means of a set screw 81. The ring 78 moves with the sleeve 76 in a cavity 82 which is closed on its outer side by a screw cap 83 which is secured in position by another said screw 84. The screw cap 83 has a blind bore into which projects the end of the tubular sleeve 76. Also positioned in the blind bore is a seal 80 which seals the passage through the sleeve 76. A second seal 79 is disposed at the opposite end at which the sleeve 76 enters the cavity 82. The full working pressure which acts on the left-hand end face of the sleeve 76 is transmitted to the interior of the sleeve 76 and also acts on the right-hand end of the latter. Thus, there is at the sleeve 76 an equalization of pressure so that in the event of a movement of the sleeve 76 it is not necessary for the full hydraulic pressure of the unit to be overcome. The sleeve 76 is adjusted by utilizing a handle 77 which passes through a bore in the screw cap 80 and which is threaded into a threaded bore of the ring 78. Considering the position shown in FIG. 7, if the handle 77 is pressed inwardly or to the left the tubular sleeve 76 is displaced in the same direction by the ring 78 and in turn displaces the control slide valve 48 to the left. This brings the control slide valve 48 to the position shown in FIG. 8 at which the overall unit is relieved of hydraulic pressure.

In order to attach the piston cylinder unit to a wall 85 of the housing 1 a spherical bearing consisting of a ball part 86 is rigidly provided on the housing 1 of the overall unit. A ball cup 87 is provided on the ball part 86 and is self-adjusting. The parts 86, 87 are seated on a sleeve 88 in which the switching device 75 is located. The sleeve 88 is pushed into a hole in the wall 85 and is secured from an opposite side by a retaining ring 89 which is held fast by a locking washer 90 mounted on the sleeve 88. An elastic ring 91 is seated in an annular groove (unnumbered) of the ring 89 which presses the wall against the plain side (unnumbered) of the ball cup 87. In this way the piston-cylinder unit can adjust itself freely to the relevant annular position within the housing 1.

What is claimed is:

1. A tool for rotating an element comprising a ring having ratchet teeth, said ring being driven by a lever, a pawl carried by said lever for engaging said ratchet teeth, tension-applying means for frictionally gripping and releasing said ring upon rotation of said lever in opposite directions, said tension-applying means including a flexible tension-applying member in at least partial surrounding relationship to said ring, means for supporting said pawl, and said tension-applying member being disposed between said supporting means and said lever in generally surrounding relationship to said ring whereby upon movement of said lever in a first direction said pawl rotates said ring through the engagement of a tooth of the ring and said tension-applying member frictionally grips said ring, and movement of said lever in a second direction opposite said first direction releases the frictional grip between said tension-applying member and said ring.

2. The tool as defined in claim 1 wherein said pawl includes at least two catches, and each catch engages a face of different teeth of said ring.

3. The tool as defined in claim 1 wherein said pawl includes at least two catches, each of said catches having a flank for engaging a face of a different tooth of said ring, and the flank of a leading one of said catches relative to the ratchet tooth pitch is slightly ahead in phase of the flank of a trailing one of said catches.

4. The tool as defined in claim 1 including a projection movably carried by said pawl and normally projecting beyond said pawl for additionally engaging said ratchet teeth.

5. The tool as defined in claim 4 wherein said pawl is slidable, said projection is slidable, and the sliding movements of said pawl and projection are in generally transverse relationship to each other.

6. The tool as defined in claim 5 wherein said projection includes a longitudinal axis disposed generally tangentially relative to said ring.

7. The tool as defined in claim 4 including spring means for biasing said projection at least in part beyond said pawl.

8. The tool as defined in claim 4 wherein said projection includes a longitudinal axis disposed generally tangentially relative to said ring.

9. A tool for rotating an element comprising a ring having a peripheral surface defining ratchet teeth with gaps therebetween, a single pawl means for drivingly engaging said teeth upon rotation of said tool in a first direction and being free running upon rotation of said tool in a second direction opposite said first direction, said single pawl means having at least one catch, a projection carried by said one catch for engaging flanks of said teeth, spring means for biasing said projection in a direction toward the flank of a tooth adapted to be engaged thereby, and said projection and said one catch contact the flank of the same tooth.

10. The tool as defined in claim 9 wherein said pawl means carries a second catch, and said one catch is disposed forwardly of said second catch relative to the free-running direction of rotation of said tool.

11. The tool as defined in claim 9 including spring means for biasing said pawl means toward said ratchet teeth.

12. The tool as defined in claim 9 wherein said projection includes a longitudinal axis disposed generally tangentially relative to said ring.

13. The tool as defined in claim 9 wherein said pawl means carries a second catch, a slot in said pawl means opening toward said ring, and said second catch being a spring plate disposed in said slot and having an end portion projecting therefrom for engaging said teeth.

14. A rotary tool comprising a driving member having a general axis of rotation, a lever mounted for oscillatory movement generally about said axis, said driving member having ratchet teeth arranged about the periphery thereof, a pawl carried by said lever for one-way driving engagement with said ratchet teeth, and a tension-applying means connected to said lever and at least partially surrounding said driving member for frictionally gripping said driving member in response to driving engagement of said ratchet teeth by said pawl during movement of said lever in a driven member rotating direction.

15. The tool of claim 14 wherein said tension-applying member is integrally formed with said lever.

16. The tool of claim 14 wherein said tension-applying member is flexible and distortable under driving pressure.

17. The tool of claim 14 wherein said tension-applying member mounts said lever for oscillatory movement relative to said driving member.

18. The tool of claim 14 together with a support, and cooperating means on said support and said driving member mounting said driving member for rotation about said axis relative to said support.

19. A tool for rotating an element as defined in claim 18 comprising a ring having a peripheral surface defining ratchet teeth with gaps therebetween, pawl means for drivingly engaging said teeth upon rotation of said tool in a first direction and being free running upon rotation of said tool in a second direction opposite said first direction, said pawl means having at least two catches, a projection carried by one of said catches for engaging flanks of said teeth and spring means for biasing said projection in a direction toward the flank of a tooth adapted to be engaged thereby.

* * * * *